US006273675B1

(12) United States Patent
Magoshi et al.

(10) Patent No.: US 6,273,675 B1
(45) Date of Patent: Aug. 14, 2001

(54) COOLING ARCHITECTURE FOR FLANGES OF A STEAM TURBINE CASING

(75) Inventors: Ryotaro Magoshi; Takashi Nakano, both of Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/428,749

(22) Filed: Oct. 28, 1999

(51) Int. Cl.[7] ..... F01D 25/08
(52) U.S. Cl. ..... 415/180
(58) Field of Search ..... 415/177, 178, 415/180

(56) References Cited

FOREIGN PATENT DOCUMENTS 53-125504 11/1978 (JP) .
54-035507 3/1979 (JP) .
61-200310 9/1986 (JP) .
10-196312 7/1998 (JP) .
002133328 12/1999 (JP) .

*Primary Examiner*—John E. Ryznic
(74) *Attorney, Agent, or Firm*—Wallenstein & Wagner, Ltd.

(57) ABSTRACT

A cooling architecture for flanges of a steam turbine casing, which effectively cools the flanges coupled by bolts to prevent the leakage of the steam caused by a decrease of the fastening force of the bolts. An upper casing 10 and a lower casing 11 are joined together at flanges 12 and 13 which are fastened and secured by bolts to hermetically seal a steam turbine. Pipes 20 are secured so as to be contacted to the peripheral of the flanges 12 and 13, and a side heat insulator 15*a* is fitted thereto from the outer side. Each pipe 20 is arranged corresponding to each bolt, or a plurality of pipes are arranged corresponding to each bolt 14. The flanges 12 and 13 are heated by the internal high-temperature steam, the ambient air 30 is introduced into the pipe 20 from the lower end thereof due to the natural convection thereby to cool the flanges 12, 13 and the bolts 14. Accordingly, a decrease of the fastening force of the bolts, and steam leakage, hardly occur.

5 Claims, 3 Drawing Sheets

COOLING ARCHITECTURE FOR FLANGES OF A STEAM TURBINE CASING

BACKGROUND OF THE INVENTION

1. Field of the Invention

The present invention relates to a cooling architecture for flanges of a steam turbine casing in order to prevent the leakage of steam caused by a drop of the fastening force of bolts for fastening the flanges.

2. Prior Art

FIG. 4 is a sectional view illustrating a portion of the casing of a conventional steam turbine, wherein reference numeral 10 denotes an upper casing, and 11 denotes a lower casing. A steam turbine is hermetically sealed by these two casings to prevent the leakage of the steam to the outside. Reference numerals 12 and 13 denote flanges of the upper and lower casings 10 and 11. The two flanges 12 and 13 are joined together and are fastened by bolts 14 which are arranged every predetermined interval along the axis of the turbine to couple the upper and lower casings 10 and 11 together. Reference numeral 15 denotes a heat insulator which covers the surfaces of the flanges 12 and 13, upper parts of the bolts 14 and the surfaces of the upper and lower casings 10 and 11 as shown.

In the casing of the steam turbine constituted as above, because the steam of a high temperature flows through the inner steam turbine, the casing is heated by high temperature steam, and the flanges 12 and 13 are also heated and are thermally deformed. Upon receiving the thermal deformation, the bolts 14 undergo the thermal extension and gradually decrease the fastening force after repetitions of the above-mentioned cycle. As the fastening force drops, the steam leaks through the junction surface between the flanges 12 and 13. Because the temperature of the steam is high, the leakage of the stream is dangerous. Besides, large amount of the leakage of steam affects the performance of the steam turbine.

In order to prevent the leakage of steam, there has heretofore been employed a cooling architecture shown in FIG. 5, wherein reference numerals 10 to 15 denote the same elements as those of FIG. 4. In this case, however, holes 25 are formed in the vertical direction to penetrate through the flanges 12 and 13 and the heat insulator 15 near the bolts 14 in order to prevent the bolts 14 and the flanges 12 and 13 near the bolts from being thermally deformed. Because the peripheries of the holes 25 are heated to a high temperature by the steam, natural convection flow of the ambient air 30 is generated to spontaneously cool the portions of the flanges around the bolts 14.

In the conventional casing of the steam turbine as described above, the casing, too, is heated to a high temperature due to the high-temperature steam, the bolts for coupling the flanges are thermally deformed to gradually decrease the fastening force, and the steam may leak through the junction surfaces of the flanges. As shown in FIG. 5, therefore, holes 25 are formed in the flanges 12, 13 and in the heat insulator 15 around the bolts 14, in order to cool the bolts 14 and the flanges 12 and 13 around the bolts based on the natural convection of the air.

According to the above-described conventional method, that is, perforation of the flanges 12 and 13, however, holes must be pierced through not only the flanges 12 and 13, but also the heat insulator 15, and laborious work for piercing the holes is required. Besides, the holes are clogged with the dust of the heat insulator and the air is not often naturally convected to a sufficient degree, and some countermeasure must be taken.

The present invention, therefore, provides a cooling architecture which reliably cools the flanges of the steam turbine casing based on the natural convection of the air, and by forming holes through the heat insulator, but not through the flange to create the natural convection of the air with a simple process.

SUMMARY OF THE INVENTION

In order to solve the above-mentioned problem according to a first aspect of the present invention, there is provided a cooling architecture for flanges which are formed on a steam turbine upper and lower casings for hermetically covering a steam turbine, are fastened together with bolts, and are covered with heat insulators including upper and lower casings, and bolts, wherein pipes for introducing the air are arranged at the contact surface near the bolts between the outer surfaces of the flanges and the heat insulator for covering the outer surfaces of the flanges, and extended upward and downward beyond the outer surfaces of the heat insulator.

According to a second aspect of the present invention there is provided a cooling architecture for flanges, which are formed on turbine upper and lower casings for hermetically covering a steam turbine, are fastened together with bolts, and are covered with heat insulators including the upper and lower casings and bolts, wherein grooves for introducing the air are formed through the heat insulator covering the outer surfaces of the flanges so as to be contacted to the outer surfaces of the flanges near the bolts.

In the flange-cooling architecture according to the first aspect, the pipes are arranged in the heat insulators so as to contact with the flanges. The flanges are heated at high temperatures by the high-temperature steam. As the bolts fastening the flanges are thermally deformed, the fastening force of the bolts decreases. Here, however, the flanges are heated at a temperature higher than the temperature of the surrounding air. Accordingly, the air are introduced into the pipes from the lower ends thereof and flows out from the upper ends by a natural convection force. Owing to the natural convection, the flanges are cooled, and the bolts are prevented from being thermally deformed and reducing the fastening force. Thus, because the fastening force does not decrease, no gap develops between the two flanges, and the steam does not leak. The number of the pipes can be increased along the axial direction to obtain a more reliable cooling effect if necessary.

According to the cooling architecture of the second aspect, the grooves are formed through the heat insulator covering the outer surfaces of the flanges near the bolts so as to contact with the outer surfaces of the flanges instead of providing the pipes. Therefore, no pipe is required, and no hole needs be pierced in the flanges which are rigid members unlike that of the prior art. Thus, the air is introduced into the grooves in the same manner as in the first aspect, the flanges and bolts are cooled by the natural convection, and the cooling architecture is constructed more easily.

BRIEF DESCRIPTION OF THE DRAWINGS

The invention will now be described in greater detail by way of embodiments with reference to the drawings, in which.

DESCRIPTION OF THE PREFERRED EMBODIMENTS

Figure 1:
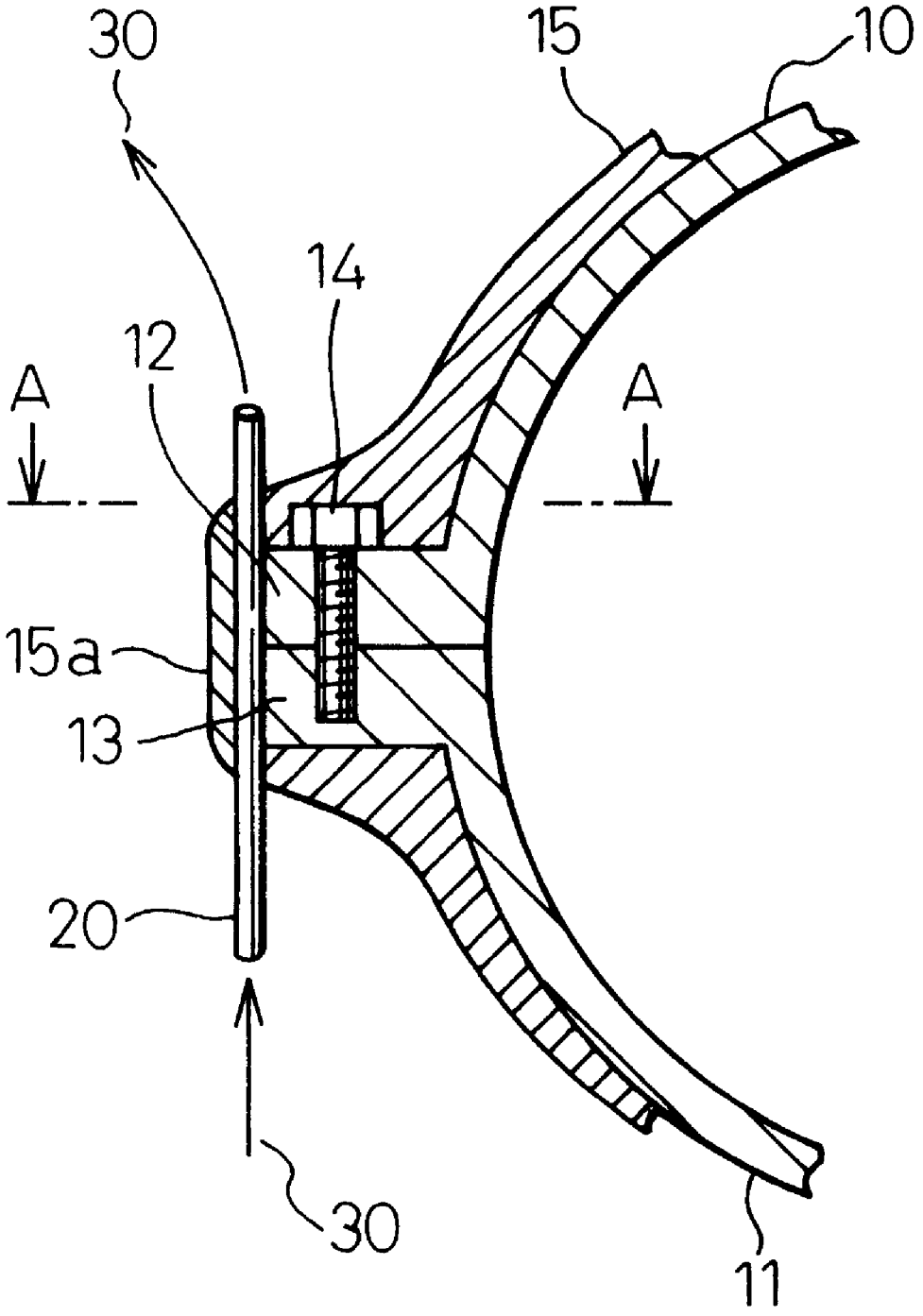
FIG. 1 is a sectional view illustrating a cooling architecture for flanges of a steam turbine casing according to a first embodiment of the present invention.

An embodiment of the present invention will now be concretely described with reference to the drawings. FIG. 1 is a sectional view illustrating a cooling architecture for flanges of a steam turbine casing according to a first embodiment of the present invention, and wherein reference numerals 10 to 15 denote the same elements as those of the prior art and the description concerning them is not repeated. The present invention features pipes designated at 20 and a side heat insulator designated at 15*a*, which will now be described in detail.

In FIG. 1, pipes 20 are mounted being contacted to the peripheral end surfaces of the flanges 12 and 13 near bolts 14, and a heat insulator 15*a* is secured to cover the peripheral end surfaces of the flanges 12 and 13. The pipes 20 have such a length that the upper ends and the lower ends thereof protrude sufficiently beyond the heat insulator 15.

Figure 2A:
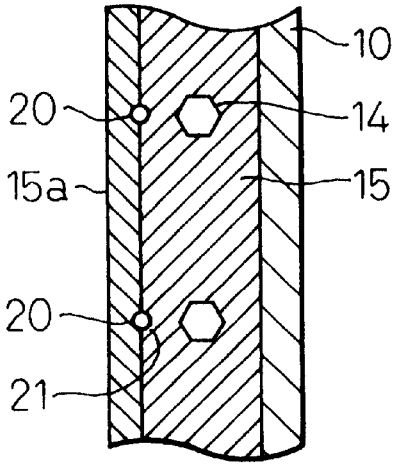
FIG. 2 is a sectional view along the line A—A in FIG. 1, wherein FIG. 2(*a*) illustrates an example in which a pipe is provided for a bolt, and FIG. 2(*b*) illustrates an example in which three pipes are provided for a bolt.
Figure 2B:
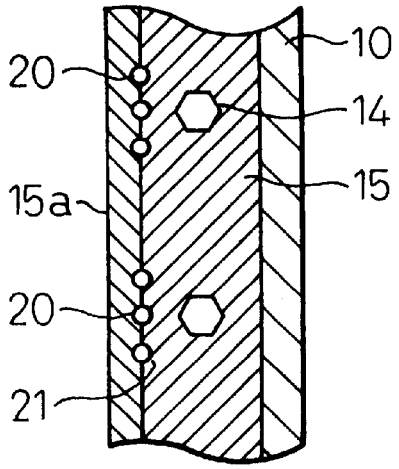

FIG. 2 is a sectional view along the line A—A in FIG. 1, wherein the bolts 14 are arranged maintaining a predetermined pitch in the lengthwise direction of the flanges 12 and 13 to fasten the two flanges together. In FIG. 2(*a*), a pipe 20 is provided for each bolt 14 at a position opposed to the bolt 14. If semicircular grooves 21 of a diameter one-half that of the pipe are formed in the flanges to secure the pipes 20 to the peripheral end surfaces of the flanges 12 and 13, then, the pipes 20 can be easily secured to the grooves 21 by welding or the like method.

FIG. 2(*b*) illustrates an example in which three pipes 20 are arranged near each bolt 14. Though the number of the pipes increases, the flanges 12 and 13 near the bolts 14 can be effectively cooled. The arrangement, other than the number of bolts, is the same as that of FIG. 2(*a*).

In the flange-cooling structure according to the first embodiment, the flanges are heated to about 400° C. due to the high temperature steam, the surrounding air 30 is introduced into the pipes 20 from the lower end of the pipes 20 due to the natural convection and flows upward to the upper ends of the pipes 20. Due to the natural convection, the bolts 14 and the flanges 12 and 13 are cooled, and thermal deformation of the bolts 14 is mitigated, so that a decrease of the fastening force of the bolts and the leakage of the steam are hardly caused.

Figure 3:
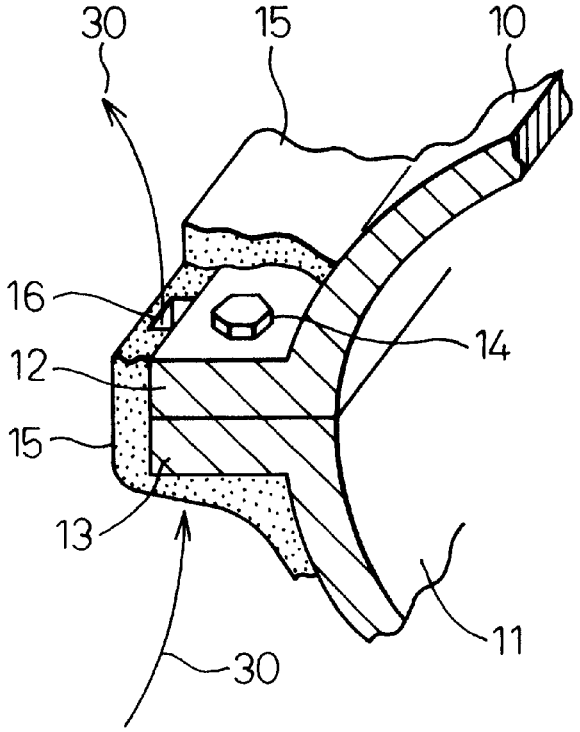
FIG. 3 is a perspective view illustrating the cooling architecture for flanges of a steam turbine casing according to a second embodiment of the present invention.
Figure 4:
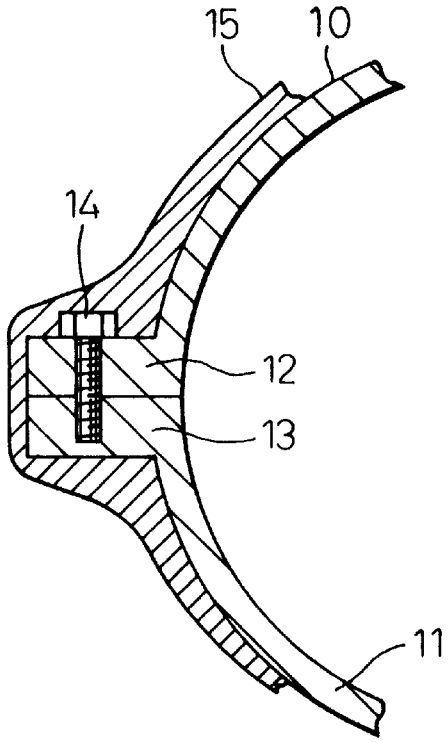
FIG. 4 is a sectional view of flange portions in a conventional steam turbine casing.

FIG. 3 illustrates the cooling architecture for flanges of the steam turbine casing according to a second embodiment of the present invention, wherein reference numerals 10 to 15 denote the same elements as those of the first embodiment shown in FIG. 1. In the second embodiment, holes 16 are formed on the heat insulator 15 along the peripheral of the flanges 12 and 13 instead of arranging the pipes 20 of the first embodiment.

Figure 5:
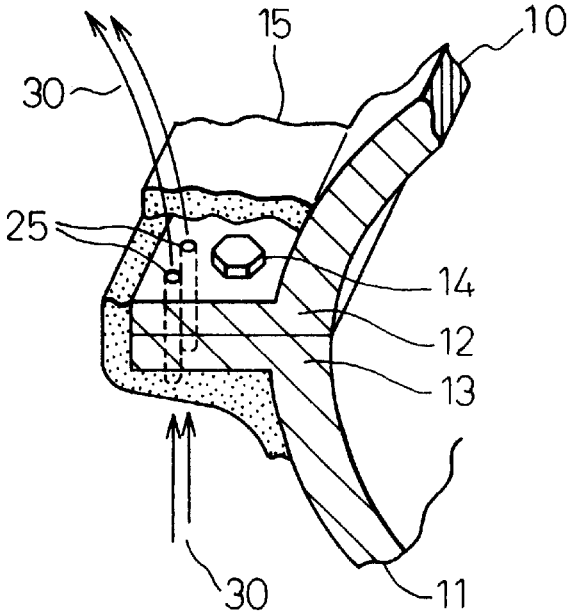
FIG. 5 is a perspective view illustrating a conventional cooling architecture for flanges of a steam turbine casing.

According to the above-mentioned second embodiment, there is no need of forming holes in the flanges 12 and 13 which are rigid members unlike the prior art shown in FIG. 5. Moreover, no pipe 20 used as the first embodiment is required. As holes are simply formed on the heat insulator 15 to create the natural convection of the air, workability is significantly improved.

According to the first and second embodiments of the present invention as described above, pipes 20 are attached to the flanges 12 and 13 of the steam turbine casing near the bolts 14, or holes 16 are pierced through the heat insulator 15 near the bolts 14 to effectively cool the bolts 14 and the flanges 12 and 13 near the bolts with the natural convection of the air. Therefore, the bolts 14 do not lose the fastening force and the leakage of the steam does not occur.

Owing to the first cooling architecture, the spontaneous convection of the air occurs, and the bolts and the flanges near the bolts are cooled by the air. The fastening force is decreased by the thermal deformation of the bolts and the leakage of the steam caused by the decrease of the fastening force of the flanges is prevented.

The second cooling architecture does not need holes formed directly on the flanges that are rigid members unlike that of the prior art, and does not require the pipes as in the first aspect. Like in the first aspect, because the air is introduced into the grooves to cool the flanges and bolts as a result of the natural convection, the leakage of the steam is prevented and workability is improved.

What is claimed is:

1. A cooling architecture for a steam turbine comprising:

an upper and a lower casing forming an upper and a lower flange;

at least one bolt fastening the upper and lower flange;

a heat insulator having outer surfaces, the insulator covering the casings and tile bolt; and pipes for cooling the bolt and the flanges.

2. The cooling architecture of claim 1 wherein the pipes are vertically arranged near the flanges and through the insulator.

3. The cooling architecture of claim 2 wherein the pipes extend beyond the outer surfaces of the insulator.

4. The cooling architecture of claim 3 wherein the pipes are arranged in the insulator as to contact the flanges.

5. The cooling architecture of claim 4 wherein the pipes allow the passage of air from a lower end thereof out from an upper end effectively cooling the flanges.

* * * * *

UNITED STATES PATENT AND TRADEMARK OFFICE

CERTIFICATE OF CORRECTION

PATENT NO. : 6,273,675 B1
DATED : August 14, 2001
INVENTOR(S) : Ryotaro Magoshi and Takashi Nakano It is certified that error appears in the above-identified patent and that said Letters Patent is hereby corrected as shown below:

Column 1,
Line 35, after "of the" delete "stream" and insert -- steam --;
After "large" delete "amount" and insert -- amounts --.

Column 2,
Line 27, after "the air" delete "are" and insert -- is --.

Column 4,
Line 44, after "casings and" delete "tile" and insert -- the --.

Signed and Sealed this

Seventh Day of May 2002

*Attest:*

*Attesting Officer*

JAMES E. ROGAN
*Director of the United States Patent and Trademark Office*